United States Patent [19]

Kimura et al.

[11] 3,934,070

[45] Jan. 20, 1976

[54] RECORDING SHEET AND COLOR DEVELOPER THEREFOR

[75] Inventors: Shiro Kimura; Sadao Ishige, both of Kanagawa; Hajime Kato, Fujinomiya; Takao Hayashi, Fujinomiya; Akio Miyamoto, Fujinomiya, all of Japan

[73] Assignee: Fuji Photo Film Co., Ltd., Kanagawa, Japan

[22] Filed: Oct. 16, 1973

[21] Appl. No.: 406,994

Related U.S. Application Data

[63] Continuation of Ser. No. 192,594, Oct. 26, 1971, abandoned.

[30] Foreign Application Priority Data

| | | |
|---|---|---|
| Oct. 23, 1970 | Japan | 45-93247 |
| Oct. 27, 1970 | Japan | 45-94874 |
| Dec. 10, 1970 | Japan | 45-109872 |

[52] U.S. Cl. ..... 428/342; 428/343; 428/411; 428/488; 428/539

[51] Int. Cl.[2] ..... B41M 5/16

[58] Field of Search ..... 117/36.2, 36.8, 36.9; 428/411, 488, 342, 343, 539

[56] References Cited

UNITED STATES PATENTS

| | | | |
|---|---|---|---|
| 2,910,377 | 10/1959 | Owen | 117/36.8 |
| 3,260,613 | 7/1966 | Otto | 117/36.9 |
| 3,287,154 | 11/1966 | Haas | 117/36.9 |
| 3,619,238 | 11/1971 | Kimura et al. | 117/36.2 |
| 3,681,390 | 8/1972 | Lin | 117/36.2 X |
| 3,682,673 | 8/1972 | Manske | 117/1.7 |
| 3,682,680 | 8/1972 | Hayashi et al. | 117/36.2 |
| 3,703,398 | 11/1972 | Ono et al. | 117/36.2 |
| 3,864,146 | 2/1975 | Oda et al. | 117/36.8 |

*Primary Examiner*—Thomas J. Herbert, Jr.
*Attorney, Agent, or Firm*—Sughrue, Rothwell, Mion, Zinn & Macpeak

[57] ABSTRACT

A color developer is disclosed which, when contacted with a color former, is capable of forming a distinct color, the color developer comprising a metallic compound of an aromatic carboxylic acid. Suitable metals are, for example, those of the following groups of the Periodic Table: I*b*, II*a*, III*b*, IV*b*, VI*a*, VII*a* and VIII. A recording sheet employing the color developer is also disclosed.

14 Claims, No Drawings

RECORDING SHEET AND COLOR DEVELOPER THEREFOR

This is a continuation of application Ser. No. 192,594, filed Oct. 26, 1971 now abandoned.

BACKGROUND OF THE INVENTION

1. Field of the Invention

The present invention relates to a recording sheet and a color developer therefor, and more particularly to a recording sheet having coated thereon a novel color developer layer and a novel color developer for the recording sheet.

2. Description of the Prior Art

There have been known recording sheets utilizing a color reaction of a colorless organic compound (hereinafter referred to as a "color former"), and an adsorbent material capable of forming a distinct color when contacted with the color former.

As the recording sheets using the phenomenon, a pressure-sensitive recording sheet (U.S. Pat. Nos. 2,505,470, 2,505,489, 2,550,471, 2,548,366, 2,712,507, 2,730,456, 2,730,457, 3,418,250, etc.) and a heat-sensitive recording sheet have been well known. Further, a printing method has been known wherein an ink containing the color former is applied to the color developer sheet either through a medium such as a stencil or not.

In all cases, the above phenomenon of the color reaction between the color former and the color developer are utilized under pressure with a pen or stylus, under heat, etc.

The color former may be dissolved in a solvent such as chlorinated diphenyl, chlorinated paraffin or other organic solvent. The solution may be dispersed in a binder and/or may be microencapsulated, and then coated on a support such as paper, plastic film, resin-coated paper, etc.

In the case of a heat-sensitive recording sheet, the color former may be coated on the support together with a thermofusible material such as acetoanilide which is melted under heating to dissolve the color former.

On the other hand, the color developer is dissolved or dispersed in water or an organic solvent together with a binder such as styrene-butadiene rubber latex and then coated on or impregnated into a base support before or directly before recording.

The color former and color developer may be coated on the same surface or opposite surfaces of a support, or on different supports.

Usually, after the color developer is coated on the support, a desensitizer is locally coated thereon in order that unnecessary color formation on certain surface portions is prevented (U.S. Pat. No. 2,777,780). Another embodiment of the prevention of color formation is to locally coat the color developer on the support or the coated layer of color former without using the desensitizer.

As the above described color developer, clays such as acid clay, active clay, attapulgite, zeolite, bentonite, etc.; phenol resins (U.S. Pat. Nos. 3,516,845, 3,540,911); and organic compouunds such as succinic acid, tannic acid, gallic acid or phenol compounds (U.S. Pat. No. 3,244,548) are known. Such organic compounds are not practically employed for the reason that the color developing ability of the color developer sheet (which is a support having coated thereon the color developer) is very low and the color developed on the sheet is low in light resistance although the compound can be very easily handled in manufacturing the color developer sheet.

Further, in the case where the above color developer is locally coated on a support to form a color developer sheet, even if a large amount thereof (7–10 g per 1 $m^2$ of the support) is coated thereon, the color developer sheet cannot form a sufficient color when contacted with the color former. As a result, the local coating method is limited in utility.

In this case, since the locally-coated portion of the color developer sheet is thicker than the other portions, the color former coated on another support, when contacted with the color developer sheet, is locally pressurized to form unpreferable color (hereinafter referred to "fog").

SUMMARY OF THE INVENTION

The inventors have found that all defects of the color developer sheet and ink can be completely removed by using a metallic compound of an aromatic carboxylic acid. That is, the inventors have found that a color developer composed of a metallic compound of an aromatic carboxylic acid is far stronger in color developing ability than an aromatic carboxylic acid or a metallic compound, and that the color formed on the color former sheet is stronger in light resistance.

DESCRIPTION OF THE PREFERRED EMBODIMENTS

The metal compound of the aromatic carboxylic acid used in the color developer of the present invention can be prepared by reacting an alkali metal salt of an aromatic carboxylic acid and a water-soluble metal salt in a solvent in which both are soluble. In this case, the ratio of the alkali metal salt and water-soluble metal salt is not particularly limited, but a molar ratio of 1 : 1 is preferable. The alkali metal salt of the aromatic carboxylic acid used in the above reaction can be prepared by conventional synthesis methods. For example, it may be prepared by reacting an aromatic carboxylic acid with an alkali metal hydroxide or carbonate.

The aromatic carboxylic acid used in the present invention includes, for example, benzoic acid, o-nitrobenzoic acid, m-nitro benzoic acid, p-nitrobenzoic acid, o-chlorobenzoic acid, m-chlorobenzoic acid, p-chlorobenzoic acid, o-toluic acid, m-toluic acid, p-toluic acid, o-bromobenzoic acid, m-bromobenzoic acid, p-bromobenzoic acid, o-iodo-benzoic acid, m-iodobenzoic acid, p-iodobenzoic acid, 4-methyl-3-nitrobenzoic acid, 2-chloro-4-nitrobenzoic acid, 2,3-dichlorobenzoic acid, 2,4-dichlorobenzoic acid, p-isopropyl-benzoic acid, 2,5-dinitrobenzoic acid, 3,4-dinitrobenzoic acid, 3,5-dinitrobenzoic acid, p-tert-butylbenzoic acid, N-phenyl-antranillic acid, 4-methyl-3-nitrobenzoic acid, 4-acetyl-benzoic acid, salicylic acid, 5-tert-butyl-salicylic acid, 3-phenyl-salicylic acid, 3-methyl-5-tert-butyl-salicylic acid, 3,5-di-tert-butyl-salicylic acid, 3,5-di-tert-amyl-salicylic acid, 3-cyclohexyl-salicylic acid, 5-cyclohexyl-salicylic acid, 3-methyl-5-isoamyl-salicyclic acid, 5-isoamyl-salicyclic acid, 3,5-di-sec-butyl-salicyclic acid, 5-nonyl-salicyclic acid, 3-methyl-5-lauryl-salicyclic acid, m-hydroxy-benzoic acid, p-hydroxybenzoic acid, 3,5-di-nitro-salicyclic acid, 2-hydroxyl-3-methyl-benzoic acid, 2,4-cresotinic acid, 2,5-cresotinic acid, 2,3-cresotinic acid, 2,4-dihydroxybenzoic acid, 2,5-dihydroxybenzoic acid, 2,6-dihydroxybenzoic acid, 1-naphthoic acid, 2-naphthoic acid, 1-hydroxyl-2 -naphthoic acid, 2-hydroxyl-3-naphthoic acid, 2-hydroxyl-1-naphthoic acid, 5,5'-methylene-salicyclic acid, thiosalicyclic acid, trimellitic anhydride, anacardic acid, benzoic anhydride, 2-carboxybenzaldehyde, diphenic acid, etc. Above all, aromatic carboxylic acids having at least one hydroxyl group in the structure, especially in the ortho position, are effective.

The metals of the metal salts to be reacted with the alkali metal salts of the carboxylic acids include, for example, group I*b* metals such as copper, silver, etc., the group II*a* metals such as magnesium, calcium, etc., the group II*b* metals such as zinc, cadmium, mercury, etc., the group III*b* metals such as aluminum, gallium, etc., the group IV*b* metals such as tin, lead, etc., the group VI*a* metals such as chromium, molybdenum, etc., the group VII*a* metals such as manganese, etc., the group VIII metals such as cobalt, nickel, etc., and the like. Among these, those salts wherein zinc, tin, aluminum or nickel is used are especially effective. In using them in the reaction, they are used in the form of the inorganic salts thereof such as chloride, sulfate, nitrate, etc., or in the form of the organic salts thereof such as oxalate, acetate, etc. These metal salts or alkali metal salts of the aromatic carboxylic acid exhibit almost no color-developing ability when used separately, but, when their reaction product is coated onto a support, the metal salts of the carboxylic acids show excellent color-developing ability.

The metal salt of the aromatic carboxylic acid which is prepared by the reaction between the alkali metal salt of the aromatic carboxylic acid and a water-soluble metal salt may be used as the reaction mixture or, more preferably, after separation and purification thereof.

Further, for the purpose of increasing color developing ability and light resistance, an inorganic pigment may be added to the color developer. The inorganic pigment comprises aluminum silicate, zinc silicate, lead silicate, tin silicate, colloidal hydrated aluminum silicate, zeolite, bentonite, kaolinite active clay, acid clay, talc and the like. The amount of inorganic pigment is not critical, for example, more than 1 part by weight, preferably 5 parts by weight per 100 parts by weight of the metal compound of the aromatic carboxylic acid may be used.

The color developer of the invention can be prepared by dissolving or dispersing the metal compound of the aromatic carboxylic acid in water or in an organic solvent such as methanol, ethanol, butanol, ethyl acetate, butyl acetate, benzene, toluene acetone, tetrahydrofuran or methylene chloride. Further, the water and organic solvent may be mixed. A preferable solvent is one which is capable of dissolving the organic carboxylic acid. In case of adding the inorganic pigment, it may be dispersed in water, the organic solvent, the solution or the dispersion. Its concentration can be decided according to the conventional manner.

The thus-prepared solution or dispersion can be coated onto a support, if necessary, together with a binder such as gum arabic, ethyl cellulose, styrene-butadiene copolymer, nitro-cellulose, styrene-butadiene latex, methylmethacrylate-butadiene latex, etc. The amount of the binder can be easily decided by one skilled in the art. It should be noted that the coated layer of color developer can be maintained on the support even if the binder is not present in the layer.

The amount of the color developer coating composition is not specifically limited to obtain sufficient color. For example, it may be more than 0.1 g/m², preferably 0.5 – 5 g/m². The upper limit of coating amount is not limited from the point of view of color developing activity, and the above range is only due to economic reasons.

The color developer composition can be coated onto the support by all kinds of coating methods because the present invention is basically characterized by using the metallic compound of the aromatic carboxylic acid.

As another embodiment for preparing a color developer composition, the binder is dissolved in the organic solvent and a plasticizer is added and then the metallic compound of the aromatic carboxylic acid is dissolved or dispersed in the resulting solution.

The plasticizer may comprise esters of phosphoric acid, phthalic acid, adipic acid or sebacic acid (e.g., tributyl phosphate, dibutyl phthalate, dioctyl phthalate, butyl adipate, dibutyl sebacate); hydrocarbons such as chlorinated paraffin; and glycerides of unsaturated fatty acids such as castor oil.

In this case, for the purpose of stabilizing the color developer composition which may be used as a coating ink, an alkali metal salt of an organic acid, or an alkali may be added to the composition. The alkali metal salt of an organic acid is, for example, a lithium salt, sodium salt or potassium salt of butyric acid, caprylic acid, palmitic acid, oleic acid, linoleic acid, linolenic acid, benzoic acid, and the like. The alkali are, for example, sodium hydroxide, potassium hydroxide, sodium carbonate, sodium silicate, borax and conventional alkali compounds. The amount of the alkali is 0.01 – 1 parts by weight per 1 part by weight of the metal compound of the aromatic carboxylic acid.

Each component is dissolved or dispersed by means of a ball mill or sand mill.

The thus-prepared color developer ink can be locally applied to a support.

The color developer sheet and color developer of the present invention can be used in combination with conventional color formers such as crystal violet lactone, benzoyl leuco methylene blue, malachite green lactone, rhodamine B lactam, fluoranes (U.S. Pat. Nos. 3,501,331, 3,514,310, 3,514,311, 3,540,911), spiropyrans (U.S. Pat. No. 3,293,060), mixtures thereof and the like.

Modifications of the invention can be easily carried out by one skilled in the art in accordance with conventional information, techniques and the like.

Color formers for use in pressure-sensitive copying paper are ordinarily employed in combination in order to secure the instantaneous color forming property and light fastness of the colored image. For example, a combination of instantaneous color forming crystal violet lactone or 3-methyl-2,2'-spirobi [benzo(*f*)]-chromene as a primary color former and benzoyl leuco-methylene blue having an excellent light fastness has been most well known, however, the colored image obtained by contacting this combination of color formers with an aromatic carboxylic acid tends to disappear when it is allowed to stand in a room or is exposed to sunlight, since crystal violet or chromene fades before benzoyl leuco-methylene blue is color formed. However, such a defect as described above is removed in the present invention, since a color developer sheet using a metallic compound of an aromatic carboxylic acid and crystal violet lactone or chromene is strong in light fastness and does not fade before benzoyl leuco methylene blue is color formed. This will be clear from the light fastness of the crystal violet lactone in the below-described Examples.

In comparison with conventional clay-coated papers, the color developer sheet of the present invention has the following advantages:

The sensitivity of the clay of conventional clay-coated paper tends to decrease when allowed to stand in air, because of adsorbing materials in the air on the active point of the clay. That is, the color developing ability of the color developer sheet is remarkably lowered with time.

In the color developer sheet of the present invention, such defect has been improved. And, in case of manufacturing a color developer sheet in accordance with the present invention, sufficient color developing ability and other properties necessary to the color developer sheet for pressure sensitive paper can be satisfied with smaller coating amounts than in the conventional clay paper. That is, the amount of color developer of the present invention to be coated is sufficient with 0.1 to 5 g/m² while in the conventional clay paper the amount to be coated is 7 to 10 g/m². Thus, it is possible to make the color developer sheet by a size spray coating technique by means of a machine because only a small amount is necessary and the physical properties of the liquid can be freely varied different from clay, which results in a remarkable effect not only on performance but also on production.

Furthermore, the color developer of the present invention can give similar color developing ability even when a smaller amount (by about 2 g/m²) of it is coated if a natural or synthetic high molecular weight substance or a water repellant is previously coated onto the surface of the paper support.

The present invention will be illustrated using the environment of a pressure-sensitive recording paper in the following Examples.

The effect of the color developer sheet of the present invention was confirmed by use with a color former sheet, produced as follows.

Microcapsules containing a color former were manufactured, for example, according to the specification of U.S. Pat. No. 2,800,457, as follows:

10 Parts by weight of acid-treated pig skin gelatin and 10 parts by weight of gum arabic were dissolved in 400 parts by weight of water at 40°C and 0.2 part by weight of Turkey red oil was added thereto as an emulsifier, and 40 parts by weight of color former oil were emulsified and dispersed therein.

The color former oil is 2% crystal violet lactone of 3-di-benzylamino-7-diethylaminofluorane dissolved in an oil consisting of 4 parts by weight of chlorinated diphenyl and 1 by weight of kerosene. The emulsification was stopped when the size of the oil droplets became 5 microns on an average. Water at 40°C was added thereto to 900 parts by weight in total and the stirring was continued. At this time attention must be paid so that the liquid temperature does not lower to below 40°C. Next, 10% acetic acid was added thereto to adjust the pH of system to 4.0 to 4.2 and to cause coacervation. The stirring was further continued and, after 20 minutes, the system was cooled with ice to gelate a coacervate film deposited around the oil droplets. When the liquid temperature became 20°C, 7 parts by weight of 37% formaldehyde were added thereto and at 10°C, a 10% aqueous solution of caustic soda was added to adjust the pH to 9. At this time, addition of caustic soda must be carried out with sufficient attention.

The liquid temperature was raised to 50°C by heat under stirring for 20 minutes. The microcapsules thus obtained were controlled to 30°C and thereafter were coated onto 40 g/m² paper in an amount of 6 g/m² as solid content and dried. Also, in case of other color formers the recording paper was manufactured in the same manner as described above.

The alkali metal salt of the aromatic carboxylic acid used for the production of the developing sheet of the invention is prepared by reacting an aromatic carboxylic acid with an alkali metal hydroxide or carbonate. An example of this procedure is as follows: 30 g of sodium hydroxide is dissolved in 300 ml of water, to which 100 g of salicycilic acid is then added with agitation. The agitation is continued for a while to dissolve the salicylic acid completely and then the solution is evaporated to dryness to obtain 110 g of sodium salicylate.

Sodium salts and potassium salts of aromatic carboxylic acids may also be prepared by methods similar to that mentioned above.

The following examples are provided to further illustrate the invention in more detail without limiting the samme.

EXAMPLE 1

0.69 G equivalent of the sodium salt of the aromatic carboxylic acid shown in Table 1, obtained by the above mentioned procedure, was dissolved in 150 ml of warm water. On the other hand, 0.6 g equivalent of the water-soluble metal salt shown in Table 1 was dissolved in 150 ml of warm water and added to the above mentioned aqueous solution of the sodium aromatic carboxylate with agitation. After a while, a metal compound of the aromatic carboxylic acid was precipitated. It was then filtered and washed with water several times to obtain the same.

10 G of the binder shown in Table 1 was then dissolved in 300 ml of the solvent shown therein, into which 70 g of the resulting metal salt of the aromatic carboxylic acid and 30 g of the inorganic pigment shown in Table 1 were dispersed or dissolved. The so-obtained solution was applied to an original paper of a weight of 50 g/m² in an amount sufficient to give a coating of a weight of 3 g/m² by means of a coating rod, followed by drying.

EXAMPLE 2

0.1 G equivalent of the sodium salt of the aromatic carboxylic acid, shown in Table 1, obtained by the above-mentioned procedure and 10 g of gum arabic were dissolved in 150 ml of water. On the other hand, 0.1 g equivalent of the water-soluble metal salt shown in Table 1 was dissolved in 150 ml of warm water and added thereto with agitation. When the stirring was continued for a while, fine crystals deposited. 50 g of the inorganic pigment (see Table 1) was dispersed in the resulting dispersion and applied to an original paper of a weight of 50 g/m² in an amount sufficient to give a coating of a weight of 4 g/m² by means of a coating rod followed by drying.

COMPARATIVE EXAMPLE 1'

7 G of binder was dissolved in 300 ml of solvent, in which 70 g of a metal salt of an aromatic carboxylic acid was dispersed. The resulting dispersion was applied to an original paper of a weight of 50 g/m² to give a coating of 2.1 g/m² by means of a coating rod following by drying (see Table 1).

COMPARATIVE EXAMPLE 2'

0.1 G equivalent of the sodium salt of an aromatic carboxylic acid and 7 g of gum arabic were dissolved in 150 ml of warm water, to which 0.1 g equivalent of a water-soluble metal salt dissolved in 150 ml of warm water was added with stirring. When the stirring was continued for a while, fine crystals deposited. The resulting dispersion was applied to an original paper of a weight of 50 g/m² to give a coating of 3 g/m² by means of a coating rod, followed by drying (see Table 1).

COMPARATIVE TEST 1

The developing sheets of Examples 1' and 2', and Comparative Examples 1' and 2' were contacted with microcapsule sheets containing crystal violet lactone and pressurized under a load of 600 kg/cm². After being allowed to stand in the dark for a day and a night, the reflective absorption spectrum at a wavelength of 400 – 700 mμ was measured, the extinction factor at its absorption maximum (which will hereinafter be referred to as "density") being defined as the "fresh density". After being further exposed to sunlight for 1–2 hours, the reflective absorption spectrum on the developed surface was measured to give its density. From the foregoing results, a value of light resistance defined by the following relation was obtained:

$$\text{Light resistance (\%)} = \frac{\text{Density of color images after exposure to sunlight}}{\text{Fresh density of color images}}$$

The results are shown in Table 1.

TABLE 1

| No. | Example or Comparative Example | Aromatic carboxylic acid | Water-soluble metal salt | Inorganic pigment | Solvent | Binder | Fresh Density | Light Resistance after Exposure for 2 hours (%) |
|---|---|---|---|---|---|---|---|---|
| 1 | 1 | Salicylic Acid | Zinc sulfate | Colloidal Aluminum Silicate Hydrate | Ethanol | Ethyl Cellulose | 1.00 | 93.0 |
| | 1' | " | " | — | " | " | 0.72 | 83.0 |
| 2 | 1 | " | Tin Chloride | Zeolite | Ethanol: Water 3:1 | | 1.01 | 80.0 |
| | 1' | " | " | — | " | | 0.68 | 57.0 |
| 3 | 1 | " | Tin sulfate | Bentonite | Ethanol | " | 0.88 | 61.0 |
| | 1' | " | " | — | " | " | 0.69 | 52.6 |
| 4 | 1 | " | " | Zinc Silicate | " | " | 0.98 | 83.4 |
| 5 | " | " | " | Kaolin | " | " | 1.06 | 70.0 |
| 6 | " | " | " | Zinc oxide | " | " | 0.94 | 72.5 |
| 7 | " | " | " | Active Calcium Carbonate | Benzene | SBR | 0.93 | 60.0 |
| | 1' | " | " | — | Benzene | SBR | 0.71 | 57.5 |
| 8 | 2 | " | Manganese Sulfate | Colloidal Aluminum Silicate Hydrate | Water | Gum Arabic | 0.39 | 60.2 |
| | 2' | " | " | — | " | " | 0.28 | 51.7 |
| 9 | 2 | " | Cobalt Sulfate | Zinc oxide | " | Polyvinyl Alcohol | 0.45 | 52.6 |
| | 2' | " | " | — | " | " | 0.34 | 35.0 |
| 10 | 2 | " | Chromium Sulfate | Zinc Silicate | " | Gum Arabic | 0.42 | 97.0 |
| | 2' | " | " | — | " | " | 0.32 | 95.6 |
| 11 | 2 | " | Lead Sulfate | Kaolin | " | " | 0.29 | 40.1 |
| | 2' | " | " | — | " | " | 0.20 | 21.3 |
| 12 | 2 | " | Copper Sulfate | Kaolin | " | " | 0.53 | 45.0 |
| | 2' | " | " | — | " | " | 0.36 | 33.4 |
| 13 | 2 | Benzoic Acid | Zinc Sulfate | Colloidal Aluminum Silicate Hydrate | " | " | 0.40 | 41.0 |
| | 2' | " | " | — | " | " | 0.29 | 27.5 |
| 14 | 2 | o-Chloro-Benzoic Acid | Zinc Chloride | Kaolin | " | " | 0.46 | 42.7 |
| | 2' | " | " | — | " | " | 0.31 | 22.2 |
| 15 | 2 | 2-hydroxy-1-naphthoic acid | Aluminum Chloride | Kaolin | Butyl Acetate | Nitrocellulose | 0.65 | 65.5 |
| | 2' | " | " | — | " | " | 0.44 | 47.0 |
| 16 | 2 | 2-Hydroxy-3-naphthoic acid | Nickel Sulfate | Kaolin | Ethanol | Ethylcellulose | 0.62 | 95.5 |
| | 2' | " | " | — | " | " | 0.42 | 90.0 |

Note: colloidal aluminum silicate hydrate: "OSMOS", made by Shiraishi Kogyo K.K.
Zeolite: "Zeolite S" made by Sun Zeolite Kogyo K.K.
Kaolin: "GT-2" made by Sieglite Kagaku Kogyo K.K.
Bentonite: "NC-Earth" made by Nippon Talc Kogyo K.K.

Active Calcium Carbonate: "Calmos" made by Shiraishi Kogyo K.K.

COMPARATIVE TEST 2

Tests similar to those in Comparative Test 1 were carried out using a microcapsule sheet containing 3-dibenzylamino-7-diethylaminofluorane to obtain the results shown in Table 2.

COMPARATIVE TEST 3

Tests similar to those in Comparative Test 1 were carried out using a microcapsule sheet containing 3-methyl-2,2'-spirobi[benzo(*f*)]chromene as a color former to obtain the results shown in Table 3.

TABLE 2

| No. | Example or Comparative Example | Aromatic Carboxylic Acid | Water-soluble metal salt | Inorganic Pigment | Solvent | Binder | Fresh Density | Light Resistance after Exposure for 2 hours (%) |
|---|---|---|---|---|---|---|---|---|
| 1 | 1 | Salicylic Acid | Zinc Sulfate | Colloidal Aluminum Silicate Hydrate | Ethanol | Ethyl Cellulose | 0.66 | 86.5 |
| | 1' | " | " | — | " | " | 0.50 | 73.6 |
| 2 | 1 | " | Tin Sulfate | Zeolite | Ethanol: Water 3:1 | " | 0.72 | 77.5 |
| | 1' | " | " | — | " | " | 0.45 | 51.5 |
| 3 | 1 | " | Tin Sulfate | Bentonite | Ethanol | " | 0.61 | 82.0 |
| | 1' | " | " | — | " | " | 0.53 | 52.0 |
| 4 | 1 | " | " | Zinc Silicate | " | " | 0.63 | 84.0 |
| 5 | " | " | " | Kaolin | " | " | 0.65 | 78.5 |
| 6 | " | " | " | Zinc Oxide | " | " | 0.64 | 79.5 |
| 7 | " | " | " | Active Calcium Carbonate | Benzene | SBR | 0.59 | 71.2 |
| | 1' | " | " | — | " | " | 0.51 | 42.3 |
| 8 | 2 | " | Manganese Sulfate | Colloidal Aluminum Silicate Hydrate | Water | Gum Arabic | 0.34 | 82.0 |
| | 2' | " | " | — | " | " | 0.23 | 60.0 |
| 9 | 2 | " | Cobalt Sulfate | Zinc Oxide | " | Polyvinyl Alcohol | 0.32 | 97.2 |
| | 2' | " | " | — | " | " | 0.24 | 85.0 |
| 10 | 2 | " | Chromium Sulfate | Zinc Silicate | " | Gum Arabic | 0.42 | 98.2 |
| | 2' | " | " | — | " | " | 0.36 | 96.0 |
| 11 | 2 | " | Lead Sulfate | Kaolin | " | " | 0.35 | 30.3 |
| | 2' | " | " | — | " | " | 0.23 | 23.5 |
| 12 | 2 | " | Copper Sulfate | Kaolin | " | " | 0.45 | 52.6 |
| | 2' | " | " | — | " | " | 0.30 | 43.0 |
| 13 | 2 | Benzoic Acid | Zinc Sulfate | Colloidal Aluminum Silicate Hydrate | " | " | 0.32 | 31.5 |
| | 2' | " | " | — | " | " | 0.28 | 22.0 |
| 14 | 2 | o-Chlorobenzoic Acid | Zinc Chloride | Kaolin | " | " | 0.46 | 32.0 |
| | 2' | " | " | — | " | " | 0.30 | 22.6 |
| 15 | 2 | 2-Hydroxy-1-Naphthoic Acid | Aluminum Chloride | Kaolin | Butyl Acetate | Nitrocellulose | 0.48 | 47.0 |
| | 2' | " | " | — | " | " | 0.37 | 32.6 |
| 16 | 2 | 2-Hydroxy-3-Naphthoic Acid | Nickel Sulfate | Kaolin | Ethanol | Ethyl Cellulose | 0.45 | 91.2 |
| | 2' | " | " | — | " | " | 0.35 | 89.0 |

TABLE 3

| No. | Example or Comparative Example | Aromatic Carboxylic Acid | Water-soluble metal salt | Inorganic Pigment | Solvent | Binder | Fresh Density | Light Resistance after Exposure for 2 hours (%) |
|---|---|---|---|---|---|---|---|---|
| 1 | 1 | Salicylic Acid | Zinc Sulfate | Colloidal Aluminum Silicate Hydrate | Ethanol | Ethyl Cellulose | 0.71 | 76.1 |
| | | " | " | — | " | " | 0.53 | Vanished |
| 2 | " | " | Tin Sulfate | Zeolite | Ethanol: Water 3:1 | " | 0.41 | 47.5 |
| | | " | " | — | " | " | 0.32 | Vanished |
| 3 | " | " | " | Bentonite | Ethanol | " | 0.51 | 41.6 |
| | | | | — | " | " | 0.34 | Vanished |

TABLE 3-continued

| No. | Example or Comparative Example | Aromatic Carboxylic Acid | Water-soluble metal salt | Inorganic Pigment | Solvent | Binder | Fresh Density | Light Resistance after Exposure for 2 hours (%) |
|---|---|---|---|---|---|---|---|---|
| 4 | " | " | " | Zinc Silicate | " | " | 0.45 | 38.5 |
| 5 | " | " | " | Kaolin | " | " | 0.60 | 52.6 |
| 6 | " | " | " | Colloidal Aluminum Silicate Hydrate | " | " | 0.72 | 108.5 |

In the case of using the developing sheet of No. 6, exposure to the sunlight was further carried out for 10 hours to obtain a light resistance of 81.0%.

As is evident from Tables 1 to 3 when an inorganic pigment is included, the developing sheet of the invention exhitits, when stacked on a color former containing a microcapsule sheet and pressed, even more excellent developing capacity than when a metal compound of an aromatic carboxylic acid alone is used, and its developed color matter has a sufficient light resistance. Similar results were obtained regarding other color formers.

EXAMPLE 3

0.6 G equivalent of potassium salicylate prepared by the method above mentioned was dissolved in 150 ml of warm water to prepare an aqueous potassium salicylate solution. 0.6 G equivalent of zinc sulfate was dissolved in 150 ml of warm water, then added to the aqueous sodium salicylate solution under stirring. Immediately, white crystals were separated out. The resulting crystals were filtrated out and washed several times with water to obtain 90 g of a white solid. 1 G of ethyl cellulose was dissolved in 200 ml of the solvent shown in Table 4, and to this solution was added 50 g of the previously prepared white solid. The resulting solution was coated onto a base paper of a weight of 50 g/m² so that the solid ingredient thereof was coated at the thickness of 3 g/m², then dried.

EXAMPLE 4

0.3 Gram equivalent of the sodium salt of the aromatic carboxylic acid obtained in Example 3 and 10 g of the binder shown in Table 4 was dissolved in 150 ml of warm water, then 0.3 gram equivalent of the metal salt shown in Table 4 dissolved in 150 ml of warm water was added thereto under stirring. After stirring for a while, the liquid became emulsified due to the formation of fine crystals. This solution, wherein said crystals were dispersed, was coated onto a base paper of 50 g/m² with a coating rod so that the solid ingredient was coated at a thickness of 4 g/m².

COMPARATIVE TEST 4

A microcapsule sheet containing crystal violet lactone was superposed onto the color developer sheets prepared by Examples 3 and 4 and pressurized under a load pressure of 600 kg/cm². After leaving the sheet for a day in the dark, the absorption spectrum of the color images in the visible region was measured, and the absorbance (hereinafter referred to as density) at the maximum absorption was defined as the fresh density.

In addition, after irradiation with sunlight for 1 hour, the absorption spectrum of the color image surface in the visible region was measured to determine its density. From the above result, the light resistance value was determined. The results are shown in Table 4. The light resistance value is defined by the following formula:

$$\text{Light resistance value (\%)} = \frac{\text{The density of colored image after irradiation with sunlight}}{\text{Fresh density of colored images}} \times 100$$

TABLE 4

| No. | Example | Aromatic Carboxylic Acid | Metal Salt | Solvent | Binder | Fresh Density | Light Resistance value after Irradiation with Sunlight for 1 hour |
|---|---|---|---|---|---|---|---|
| 1 | 3 | Salicylic Acid | Zinc Sulfate | Ethanol | Ethyl Cellulose | 1.07 | 91.5 |
| 2 | " | " | " | Ethanol: Water (3:1) | " | 0.95 | 85.5 |
| 3 | 4 | " | Manganese Sulfate | Water | Gum Arabic | 0.56 | 75.9 |
| 4 | " | " | Cobalt Sulfate | " | " | 0.68 | 67.5 |
| 5 | " | " | Tin Sulfate | " | " | 0.86 | 79.3 |
| 6 | " | " | Nickel Sulfate | " | " | 0.82 | 84.8 |
| 7 | " | " | Chromium Sulfate | " | " | 0.64 | 97.8 |
| 8 | " | " | Lead Sulfate | " | " | 0.39 | 51.0 |
| 9 | " | " | Copper Sulfate | " | " | 0.70 | 66.7 |
| 10 | " | Benzoic Acid | Zinc Sulfate | " | " | 0.61 | 63.0 |
| 11 | " | o-Chlorobenzoic Acid | " | " | " | 0.64 | 56.0 |
| 12 | " | 2-Hydroxy-1-Naphthoic Acid | Zinc Chloride | " | " | 0.89 | 73.5 |
| 13 | " | " | Tin Chloride | " | " | 1.10 | 80.0 |
| 14 | " | " | Nickel Sulfate | " | " | 0.83 | 95.0 |
| 15 | " | 2-Hydroxy-3- | Aluminum Sul- | | | | |

TABLE 4-continued

| No. | Example | Aromatic Carboxylic Acid | Metal Salt | Solvent | Binder | Fresh Density | Light Resistance value after Irradiation with Sunlight for 1 hour |
|---|---|---|---|---|---|---|---|
| | | Naphthoic Acid | fate | " | " | 0.81 | 67.9 |
| 16 | " | Salicylic Acid | " | " | " | 0.77 | 72.0 |
| 17 | " | 2-Hydroxy-3-Naphthoic Acid | Manganese Sulfate | " | " | 0.63 | 94.5 |
| 18 | " | 5-tert-butyl Salicylic Acid | Zinc Chloride | " | Polyvinyl Alcohol | 1.12 | 90.3 |
| 19 | " | 3,5-di-tert-butyl Salicylic Acid | " | " | " | 0.95 | 85.2 |
| 20 | " | 3-phenyl Salicylic Acid | " | " | " | 0.90 | 69.5 |
| 21 | " | 3-methyl-5-tert-butyl Salicylic Acid | " | " | Styrene-Butadiene Latex | 0.94 | 76.8 |
| 22 | " | 5-cyclo-hexyl Salicylic Acid | " | " | " | 0.97 | 74.9 |
| 23 | 4 | 3,5-di-tert-amyl Salicylic Acid | " | " | " | 0.89 | 71.4 |
| 24 | 3 | 3-methyl-5-isoamyl Salicylic Acid | " | Ethanol | Ethyl Cellulose | 0.93 | 72.3 |
| 25 | " | 5-isoamyl Salicylic Acid | " | Methyl Isobutyl Ketone | " | 0.92 | 71.1 |
| 26 | " | 5-tert-butyl Salicylic Acid | Tin Sulfate | Methanol | " | 0.91 | 67.7 |
| 27 | " | 5-tert-butyl Salicylic Acid | Nickel Sulfate | " | Ethyl Cellulose | 0.91 | 71.7 |
| 28 | " | 3,5-di-tert-butyl Salicylic Acid | Zinc Sulfate | Acetone | " | 0.92 | 70.5 |
| 29 | " | 3-cyclo-hexyl Salicylic Acid | Copper Sulfate | n-Butyl Acetate | " | 0.71 | 69.2 |
| 30 | " | 3-phenyl Salicylic Acid | Manganese Sulfate | Benzene | " | 0.60 | 61.2 |
| 31 | " | 3,5-di-sec-butyl Salicylic Acid | Zinc Sulfate | Toluene | " | 0.91 | 59.6 |
| 32 | 3 | 5-nonyl-Salicylic Acid | Zinc Chloride | Benzene | " | 0.90 | 71.3 |

COMPARATIVE TEST 5

The test described in the above color-developing test 3 was carried out using a microcapsule-coated sheet containing 3-dibenzylamino-7-dimethylaminofluorane. The results are shown in Table 5.

TABLE 5

| No. | Example | Aromatic Carboxylic Acid | Metal Salt | Solvent | Binder | Fresh Density | Light Resistance value after Irradiation with Sunlight for 1 hour |
|---|---|---|---|---|---|---|---|
| 1 | 3 | Salicylic Acid | Zinc Sulfate | Ethanol | Ethyl Cellulose | 0.75 | 86.8 |
| 2 | " | " | " | Ethanol: Water (3:1) | " | 0.60 | 82.5 |
| 3 | 4 | " | Manganese Sulfate | Water | Gum Arabic | 0.45 | 80.0 |
| 4 | " | " | Cobalt Sulfate | " | " | 0.48 | 92.5 |
| 5 | " | " | Tin Sulfate | " | " | 0.80 | 70.5 |
| 6 | " | " | Nickel Sulfate | " | " | 0.79 | 90.5 |
| 7 | " | " | Chromium Sulfate | " | " | 0.72 | 98.0 |
| 8 | " | " | Lead Sulfate | " | " | 0.44 | 51.3 |
| 9 | " | " | Copper Sulfate | " | " | 0.61 | 71.5 |
| 10 | " | Benzoic Acid | Zinc Sulfate | " | " | 0.56 | 50.2 |
| 11 | " | o-Chloro-benzoic Acid | " | " | " | 0.59 | 54.5 |
| 12 | " | 2-Hydroxy-1-naphthoic Acid | Zinc Chloride | " | " | 0.73 | 79.0 |
| 13 | " | " | Tin Chloride | " | " | 0.81 | 79.4 |
| 14 | " | " | Nickel Sulfate | " | " | 0.70 | 94.5 |
| 15 | " | 2-Hydroxy-3-naphthoic Acid | Aluminum Sulfate | " | " | 0.67 | 66.2 |
| 16 | " | Salicylic Acid | " | " | " | 0.73 | 67.5 |
| 17 | " | 2-Hydroxy-3-naphthoic Acid | Manganese Sulfate | " | " | 0.57 | 92.3 |
| 18 | " | 5-tert-butyl Salicylic Acid | Zinc Chloride | " | Polyvinyl Alcohol | 0.76 | 72.4 |
| 19 | " | 3,5-di-tert-butyl Salicylic Acid | " | " | " | 0.75 | 68.3 |
| 20 | " | 3-phenyl Salicylic Acid | " | " | " | 0.65 | 67.2 |
| 21 | " | 3-methyl-5-tert- | " | " | Styrene- | 0.78 | 70.2 |

TABLE 5-continued

| No. | Example | Aromatic Carboxylic Acid | Metal Salt | Solvent | Binder | Fresh Density | Light Resistance value after Irradiation with Sunlight for 1 hour |
|---|---|---|---|---|---|---|---|
| | | butyl Salicylic Acid | | | butadiene Latex | | |
| 22 | " | 5-cyclo-hexyl Salicylic Acid | " | " | " | 0.79 | 68.8 |
| 23 | " | 3,5-di-tert-amyl Salicylic Acid | " | " | " | 0.73 | 66.3 |
| 24 | 3 | 3-methyl-5-isoamyl Salicylic Acid | " | Ethanol | Ethyl Cellulose | 0.76 | 70.0 |
| 25 | " | 5-isoamyl Salicylic Acid | " | Methyl Isobutyl Ketone | " | 0.75 | 68.1 |
| 26 | " | 5-tert-butyl Salicylic Acid | Tin Sulfate | Methanol | " | 0.73 | 65.6 |
| 27 | " | " | Nickel Sulfate | " | " | 0.62 | 66.9 |
| 28 | " | 3,5-di-tert-butyl Salicylic Acid | Zinc Sulfate | Acetone | " | 0.70 | 67.1 |
| 29 | " | 3-cyclo-hexyl Salicylic Acid | Copper Sulfate | n-butyl Acetate | " | 0.61 | 65.5 |
| 30 | " | 3-phenyl Salicylic Acid | Manganese Sulfate | Benzene | " | 0.51 | 58.0 |
| 31 | " | 3,5-di-sec-butyl Salicylic Acid | Zinc Sulfate | Toluene | " | 0.71 | 56.3 |
| 32 | " | 5-nonyl-salicylic Acid | Zinc Chloride | Benzene | " | 0.61 | 62.0 |

It can be understood from Tables 4 and 5 that, when contacted with a color former containing capsule sheet under pressure, the color developer sheet of this invention shows sufficient color density and light resistance of the color image formed.

In addition, the color image formed on the color developer sheet has resistance to the "wetting with water". Especially, when 2-hydroxy-1-naphthoic acid, 2-hydroxy-3-naphthoic acid, etc. are used, the color image formed did not disappear at all when wetted with water.

Similar results were obtained when other color formers were employed.

EXAMPLE 5

100 Parts by weight (hereinafter, "part" means "part by weight") of potassium salicylate prepared as in the above-described manner was dissolved in 150 parts of hot water, and into the solution was added with stirring 60 parts of stannous chloride dissolved in 150 parts of hot water, whereby stannous salicylate was immediately precipiated as white cyrstals. The crystals were filtered out, washed several times with water, and then dried to obtain 100 parts of stannous salicylate as solids. 40 parts of nitrocellulose was dissolved in a mixture of 15 parts of butyl acetate, 80 parts of isopropanol and 60 parts of butanol to give a homogenous solution, into which 120 parts of the above-described solid stannous salicylate was mixed and totally dissolved or dispersed by a ball mill to obtain a developer ink as a white suspension. The ink was diluted with a 1:1 mixture of ethyl acetate and ethanol to give a viscosity of about 0.7 poise and printed by a flexographic printing process to give 3 g/m $^2$ of dried coating film.

EXAMPLE 6

100 Parts of sodium 2-hydroxy-3-naphthoic acid was dissolved into 150 parts of hot water and into the solution was added with stirring 40 parts of zinc chloride dissolved in 150 parts of water, whereby zinc 2-hydroxy-3-naphthoate was immediately precipiated as crystals. The resulting mixture was concentrated to a total weight of 200 parts. Into a mixture of 15 parts of dioctyl phthalate, 120 parts of ethyl acetate, 100 parts of isopropanol and 80 parts of methanol was dissolved 50 parts of ethyl cellulose to give a homogenous solution to which were added 200 parts of the above described concentrate and 50 parts of kaolin and completely dissolved or dispersed in a ball mill to obtain a developing ink in the form of a suspension. The ink was diluted with a 1:1 mixture of ethyl acetate and ethanol to give a viscosity of about 0.7 poise and printed by a flexographic printing process to give 3 g/m$^2$ of dried coating film.

EXAMPLE 7

100 Parts of sodium o-chlorobenzoic acid obtained by the aforementioned method was dissolved in 150 parts of hot water and into the solution was added with stirring a solution of 100 parts of nickel sulfate in 150 parts of hot water, whereby crystals of nickel o-chlorobenzoic acid were immediately precipitated. The precipitate was filtered out, washed several times with water and dried to obtain 80 parts of solid nickel o-chlorobenzoic acid. Into a mixture of butyl adipate, ethyl acetate, 20 parts of methyl ethyl ketone and toluol was dissolved 8 parts of vinyl chloride-vinyl acetate copolymer to obtain a homogeneous solution into which 20 parts of the above described nickel o-chlorobenzoic acid and 10 parts of aluminum silicate hydrate (Trade Mark, "Osmos N", manufactured by Shiraishi Kogyo) were mixed followed by homogeneous dissolution or dispersion in a ball mill to obtain a developer ink. The ink was diluted with toluene to give a viscosity of about 1 poise and subjected to a gravure printing process to give 3 g/m$^2$ of dried coating film.

EXAMPLE 8

100 Parts of sodium 2-hydroxy-1-naphthoate prepared by the above method was dissolved in 150 parts of warm water and into the solution was added with stirring a solution of 60 parts of aluminum sulfate in 150 parts of warm water whereby crystals of aluminum 2-hydroxy-1-naphthoate were immediately precipitated. The precipitate was filtered out, washed several times with water and dried to obtain 70 parts of solid aluminum 2-hydroxy-1-naphthoate.

Into a mixture of 2 parts of castor oil, 20 parts of toluene, 20 parts of ethyl acetate and 20 parts of n-hexane was dissolved 8 parts of nitro cellulose to obtain a homogeneous solution. Into the solution was mixed 20 parts of the above described aluminum 2-hydroxy-1-naphthoate and 7 parts of silicon oxide (Trade Mark "Siloide") followed by homogeneously dissolving or dispersing by a ball mill to obtain a developer ink. The resulting ink was diluted with xylol to give a viscosity of about 1 poise and subjected to a gravure printing process to give about 2 g/m² of dried coating film.

EXAMPLE 9

80 parts of sodium anacardate prepared according to the afore mentioned method was dissolved in 150 parts of hot water and into the solution was added with stirring a solution of 20 parts of zinc sulfate in 150 parts of hot water to obtain zinc anacardate. The mixture was concentrated to a total weight of 200 parts and then mixed with a mixture of 40 parts of ethyl cellulose, 70 parts of ethyl cellulose, 150 parts of ethanol and 40 parts of titanium oxide followed by completely dissolving or dispersing by a ball mill to afford a developer ink in the form of an emulsion. The ink was diluted with ethanol to give a viscosity of about 1 poise and subjected to a flexographic printing process to give about 3 g/m² of dried coating film.

COMPARATIVE TEST 6

The above described paper coated with microcapsules containing crystal violet lactone was piled on each of the surface printed with each color developer ink in Examples 5–9 and pressurized under a pressure load of 600 kg/m² to form color images. After being allowed to stand in the dark for an hour, the spectral absorption curve was measured within the wave length ranging from 400 to 700 mμ, the density at the absorption maximum being defined as the fresh density.

After further irradiating with sunlight for 1 hour and for 3 hours, the spectral absorption curve of the color images was measured and its light resistance was calculated according to the following equation:

$$\text{Light resistance (\%)} = \frac{\text{Density at the absorption maximum after irradiation of sunlight}}{\text{Fresh density at the absorption maximum}} \times 100$$

The results are summarized in the following Table 6.

TABLE 6

| Example | Fresh Density | Light Resistance (%) after 1 hour Irradiation of Sunlight | Light Resistance (%) after 3 hours Irradiation of Sunlight |
|---|---|---|---|
| 5 | 0.75 | 82 | 70 |
| 6 | 0.91 | 87 | 79 |
| 7 | 0.86 | 89 | 85 |
| 8 | 0.89 | 84 | 78 |
| 9 | 0.73 | 80 | 71 |

From the Table 6, it is evident that the developer inks of the present invention are superior in their developing ability and light resistance even in the case of using a thin printed layer of 3 g/m².

COMPARATIVE TEST 7

A paper coated with microcapsules containing 3-methyl-2,2'-spirobi(benzo[*f*]chromene) was placed on each of the surfaces printed with the color developer ink in the above described Examples 5–9, and its fresh density and light resistance were measured in the same manner as described above in Comparative Test 6.

TABLE 7

| Example | Fresh Density | Light Resistance (%) after 1 hour Irradiation of Sunlight | Light Resistance (%) after 3 hours Irradiation of Sunlight |
|---|---|---|---|
| 5 | 0.70 | 70 | 62 |
| 6 | 0.85 | 73 | 65 |
| 7 | 0.73 | 91 | 87 |
| 8 | 0.82 | 79 | 66 |
| 9 | 0.69 | 68 | 58 |

As is apparent from the numerical values in the above-described Table 7, the paper surfaces printed with the developer inks of the present invention show an excellent developing ability also for the color former sheet containing 3-methyl-2,2'-spirobi(benzo[*f*]chromene). Furthermore, the paper surface printed with the ink containing aluminum silicate hydrate (Osmos N) was remarkably improved in the light resistance of the color developed image of 3-methyl-2,2'-spirobi(benzo[*f*]chromene).

What is claimed is:

1. A recording sheet comprising a support having coated thereon a color former layer containing an electron donating or proton accepting colorless color former and a color developer layer containing a zinc, aluminum or tin salt of an aromatic carboxylic acid having an OH-group at the ortho-position as a color developer capable of forming a distinct color when contacted with said color former.

2. The recording sheet of claim 1 wherein said zinc, aluminum or tin salt is coated onto said suppport in an amount greater than 0.1 g/m².

3. The recording sheet of claim 1 wherein said color developer layer further comprises an alkali metal salt of an organic acid.

4. The recording sheet of claim 1 wherein said color developer layer further comprises from 0.01 to one part by weight, for one part by weight of said zinc, aluminum or tin salt, of an alkali compound.

5. The recording sheet of claim 1 wherein said color former and said color developer are on the same surface of said support.

6. The recording sheet of claim 1 wherein said color former and said color developer are on opposite surfaces of said support.

7. The recording sheet of claim 1 wherein said color developer layer further contains an inorganic pigment.

8. The recording sheet of claim 7 wherein said inorganic pigment is added to said color developer layer in an amount greater than one part by weight per 100 parts by weight of said zinc, aluminum or tin salt.

9. A recording system comprising a first support having coated thereon a color former layer containing an electron donating or proton excepting colorless color former and a second support having coated thereon a color developer layer containing a zinc, aluminum or tin salt of an aromatic carboxylic acid having an OH-group at the ortho-position as a color developer capable of forming a distinct color when contacted with said color former.

10. The recording system of claim 9 wherein said color developer layer further contains an inorganic pigment.

11. The recording system of claim 9 wherein said zinc, aluminum or tin salt is coated onto said support in an amount greater than 0.1 $g/m^2$.

12. The recording system of claim 9 wherein said inorganic pigment is added to said color developer layer in an amount greater than one part by weight per 100 parts by weight of said zinc, aluminum or tin salt.

13. The recording system of claim 9 wherein said color developer layer further comprises an alkali metal salt of an organic acid.

14. The recording system of claim 9 wherein said color developer layer further comprises from 0.01 to one part by weight, for one part by weight of said zinc, aluminum or tin salt, of an alkali compound.

* * * * *